US009175636B2

(12) United States Patent
Dunsch et al.

(10) Patent No.: US 9,175,636 B2
(45) Date of Patent: Nov. 3, 2015

(54) CYLINDER HEAD COVER

(75) Inventors: Robert Dunsch, Vaihingen (DE); Edwin Hartmann, Weiler zum Stein (DE); Michael Kreisig, Stuttgart (DE); Stefan Ruppel, Heidelberg Emmertsgrund (DE); Jan Scheffel, Stuttgart (DE); Falk Schneider, Korntal-Münchingen (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 614 days.

(21) Appl. No.: 12/810,713

(22) PCT Filed: Oct. 20, 2008

(86) PCT No.: PCT/EP2008/064114
§ 371 (c)(1),
(2), (4) Date: Sep. 22, 2010

(87) PCT Pub. No.: WO2009/083287
PCT Pub. Date: Jul. 9, 2009

(65) Prior Publication Data

US 2011/0005490 A1 Jan. 13, 2011

(30) Foreign Application Priority Data

Dec. 31, 2007 (DE) ..... 10 2007 063 254

(51) Int. Cl.
*F01L 1/053* (2006.01)
*F02F 7/00* (2006.01)
(Continued)

(52) U.S. Cl.
CPC ..... *F02F 7/006* (2013.01); *F01L 1/053* (2013.01); *F01L 1/46* (2013.01); *F01L 2001/0476* (2013.01); *F01L 2001/0535* (2013.01); *F01L 2101/00* (2013.01); *F01L 2103/00* (2013.01)

(58) Field of Classification Search
CPC ..... F01L 1/053; F01L 2001/0476; F01L 2103/00; F01L 2001/0537; F02F 7/06; F01M 9/102
USPC ..... 123/90.27, 90.38, 195 C, 195 AC, 193.1
See application file for complete search history.

(56) References Cited

U.S. PATENT DOCUMENTS 2,089,277 A * 8/1937 Loeffler ..... 123/195 S
2,098,451 A * 11/1937 Gilmore ..... 29/888.01
(Continued)

FOREIGN PATENT DOCUMENTS

AT 003676 U1 6/2000
AT 500411 A1 12/2005
(Continued)

OTHER PUBLICATIONS

English abstract provided for DE-10034329.
(Continued)

*Primary Examiner* — Lindsay Low
*Assistant Examiner* — Kevin Lathers
(74) *Attorney, Agent, or Firm* — Fishman Stewart Yamaguchi PLLC

(57) ABSTRACT

A cylinder head cover having a bearing device that includes at least two bearing blocks for supporting a camshaft, and one connecting element. The bearing blocks are axially penetrated in a first through-opening by the camshaft and are fixed in an aligned position with respect to one another by the connecting element. The bearing blocks, the connecting element and the camshaft form a prefabricated assembly. The cylinder head cover is connected via at least one additional connecting element with the bearing device, whereby a unit consisting of the cylinder head cover and the bearing device are mounted on the cylinder head.

18 Claims, 3 Drawing Sheets

Figure 1:
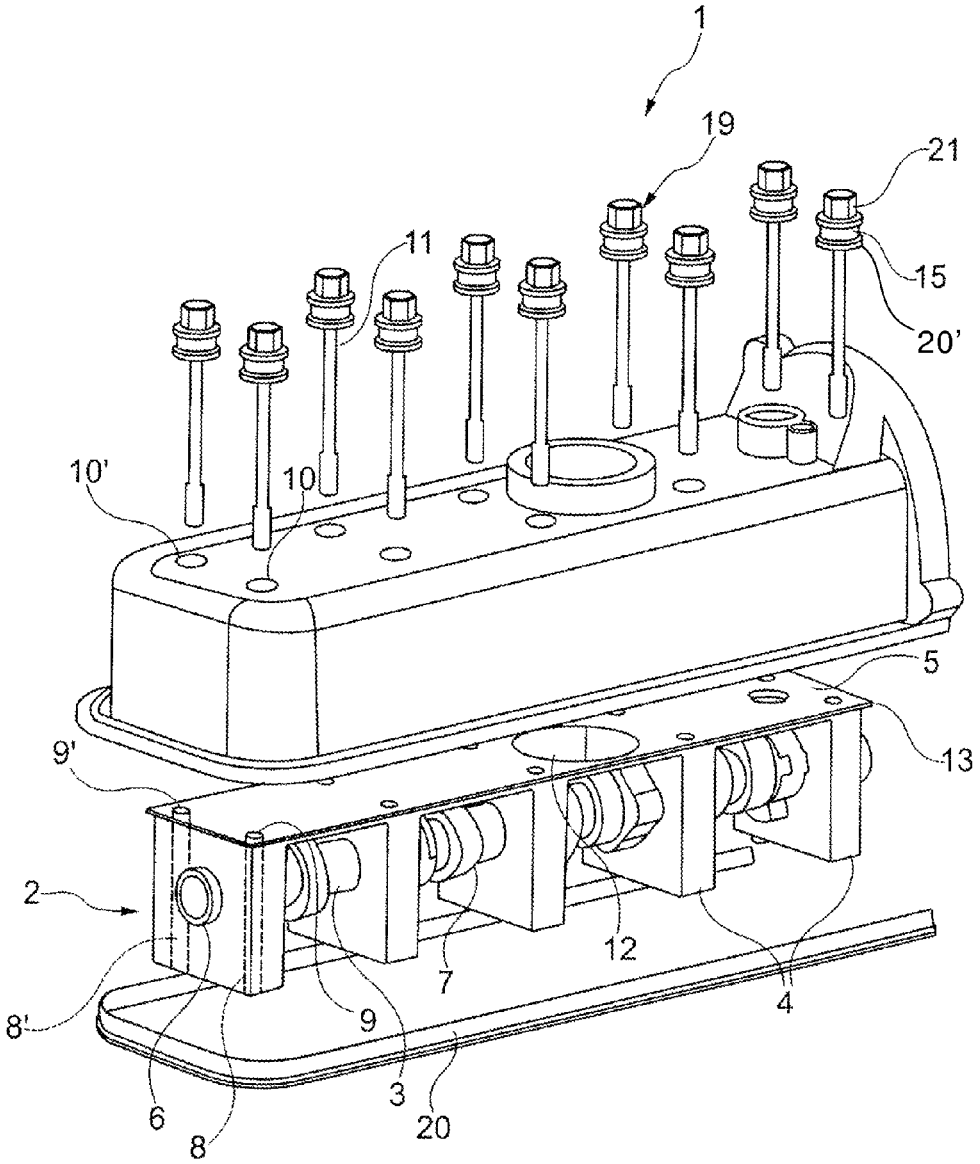

(51) Int. Cl.

| | |
|---|---|
| ***F01L 1/46*** | (2006.01) |
| *F01L 1/047* | (2006.01) |

(56) References Cited

U.S. PATENT DOCUMENTS

| | | | | | |
|---|---|---|---|---|---|
| 4,209,209 | A * | 6/1980 | Stark | 384/432 | |
| 4,522,165 | A * | 6/1985 | Ogawa | 123/195 C | |
| 4,819,953 | A | 4/1989 | Joh | | |
| 5,150,675 | A | 9/1992 | Murata | | |
| 5,562,072 | A * | 10/1996 | Stoody, Jr. | 123/90.27 | |
| 6,148,787 | A * | 11/2000 | Takano | 123/195 A | |
| 6,523,518 | B2 * | 2/2003 | Kunde et al. | 123/193.5 | |
| 6,591,801 | B1 * | 7/2003 | Fonville | 123/90.38 | |
| 6,832,587 | B2 * | 12/2004 | Wampula et al. | 123/90.38 | |
| 2002/0185094 | A1 * | 12/2002 | Yoon | 123/90.38 | |
| 2004/0144349 | A1 | 7/2004 | Wampula et al. | | |
| 2007/0012271 | A1 * | 1/2007 | Hilpert | 123/90.38 | |
| 2008/0295796 | A1 | 12/2008 | Dunsch et al. | | |

FOREIGN PATENT DOCUMENTS

| | | | | | |
|---|---|---|---|---|---|
| DE | 3639218 | A1 | 5/1988 | | |
| DE | 19603692 | A1 | 8/1997 | | |
| DE | 19807675 | A1 | 8/1999 | | |
| DE | 10034329 | A1 | 1/2002 | | |
| DE | 20120912 | U1 | 6/2002 | | |
| DE | 10331089 | A1 | 2/2005 | | |
| DE | 10331089 | A1 * | 2/2005 | | F02F 1/24 |
| DE | 10349804 | A1 | 6/2005 | | |
| DE | 102004049739 | A1 * | 4/2006 | | F02F 1/38 |
| DE | 102004049739 | A1 | 4/2006 | | |
| EP | 0461952 | B1 | 8/1993 | | |
| EP | 1108859 | A2 | 6/2001 | | |
| EP | 1998034 | A3 | 11/2009 | | |
| JP | 54044118 | A * | 4/1979 | | F02F 7/00 |
| JP | 04-082343 | | 7/1992 | | |
| JP | 8-128306 | A | 5/1996 | | |
| JP | 9-217651 | A | 8/1997 | | |
| JP | 2007-192101 | A | 8/2007 | | |
| JP | 2007-315253 | A | 12/2007 | | |
| JP | 2007-315253 | A * | 12/2007 | | F01L 1/20 |
| JP | 2007315253 | A * | 12/2007 | | 123/195 C |
| JP | 2008057406 | A * | 3/2008 | | F01L 1/04 |
| WO | WO-87/07323 | A1 | 12/1987 | | |
| WO | WO-03/106832 | A1 | 12/2003 | | |
| WO | WO-2007/083223 | A1 | 7/2007 | | |
| WO | WO-2007/083225 | A1 | 7/2007 | | |
| WO | WO-2007/083224 | A3 | 11/2007 | | |

OTHER PUBLICATIONS

English abstract provided for DE-102004049739.
English abstract for DE-10331089.
English abstract for DE10349804.
English abstract for DE-19603692.
English abstract for DE-19807675.
English abstract for JP-2007315253.
English abstract for JP-08128306.
English abstract for JP-09217651.
English abstract for EP-0461952.
English abstract for EP-1108859.
English Translation of JapaneseOffice Action for JP2010-541038 mailed Oct. 30, 2012.

* cited by examiner

CYLINDER HEAD COVER

CROSS-REFERENCES TO RELATED APPLICATIONS

This application claims priority to German patent applications DE 10 2007 063 254.3 filed on Dec. 31, 2007, and PCT/EP2008/064114 filed on Oct. 20, 2008, both of which are hereby incorporated by reference in their entirety.

TECHNICAL FIELD

The present invention relates to a cylinder head cover comprising a bearing device for supporting a camshaft in a cylinder head. The invention relates also to an internal combustion engine equipped with such a cylinder head cover.

BACKGROUND

In today's internal combustion engines, basically two different arrangements of a camshaft in a cylinder head are established. In the first variant, the camshaft is received between the cylinder head and a so-called bearing frame onto which a cylinder head cover, which is usually made of plastic, is screwed with an appropriate number of screws. Thereby, a bearing channel is formed by one bearing half-shell in the cylinder head and one in the bearing frame. The bearing channel must be machined and marked in the mounted state and must be dismantled again for assembling the camshaft. However, in contrast to these efforts there are many mounting benefits; for example, the cylinder head with associated bearing frame and appropriately fixed camshaft can be placed as one unit onto the cylinder block and can be screwed thereon. In this case, the forces of the valve springs are already applied to the camshaft which is kept in position by means of the fixation, which allows for a precisely predefined position between crankshaft and camshaft. A second variant works without a bearing frame, that is, the cylinder head cover, which, for example, is made of die-cast aluminum, is screwed directly onto the cylinder head. The second variant needs considerably fewer parts, wherein an increased noise emission is to be expected because the cylinder head cover is usually made of metal.

SUMMARY

The present invention is concerned with the problem to provide a cylinder head cover by means of which in particular a simplified camshaft mounting on the cylinder head can be achieved.

This problem is solved according to the invention by the subject matter of the independent claim 1. Advantageous embodiments are subject matter of the dependent sub-claims.

The invention is based on the general idea to form a bearing device, made of at least two bearing blocks supporting one camshaft and a connecting element connecting the bearing blocks, as prefabricated assembly and to fasten it together with the cylinder head cover as a whole in one single work step to the cylinder head without the need that the camshaft has to be aligned again afterwards. The bearing assembly comprises at least the two above-mentioned bearing blocks which support the camshaft, and the connecting element which fixates the bearing blocks in such a position that they are aligned to one another. The camshaft penetrates each of bearing blocks in an axial first through-opening. By forming the bearing device together with the camshaft to be supported as prefabricated assembly, the same can be prefabricated in an early stage in such a manner that it has to be mounted during cylinder head assembly together with the cylinder head cover to the cylinder head, whereby, in particular, a complicated and previously typical alignment of the individual bearing blocks with respect to the camshaft as well as a potentially necessary grinding of a bearing channel in the bearing blocks can be eliminated. The assembly consisting of camshaft, bearing blocks and connecting element thus forms a mounting aid for mounting the bearing device in the cylinder head. The bearing device is fabricated in that, when joining the cams onto the camshaft which, for example, can be formed as assembled camshaft, the above-mentioned bearing blocks are slid in an appropriately predefined distance over the camshaft and are subsequently aligned with respect to the camshaft. After this, a fixing of the individual bearing blocks on the connecting element takes place, in particular a welding, so that the unit consisting of camshaft, bearing blocks and connecting element, thus, the bearing device, is prefabricated and can be arranged in a later mounting step together with the cylinder head cover on the cylinder head. It is conceivable here that the cylinder head cover can be connected to the bearing device by means of appropriate connecting means, whereby assembling the unit, which now consists of cylinder head cover and bearing device, on the cylinder head can be carried out in a very simple manner.

Advantageously, the connecting element is made of metal and is welded to the bearing blocks. As connecting element, a bending resistant sheet metal can be used, the stiffness of which is high enough that a bending and, in association with that, a bearing inaccuracy of the individual bearing blocks with respect to the camshaft can be reliably avoided. The welding between the bearing blocks and the connecting element can be carried out by means of tack points which can be produced in a procedurally simple manner and which ensure, at the same time, a reliable fixation of the bearing blocks on the connecting element.

Advantageously, on at least one bearing block, a second through-opening is provided which runs transverse to the first through-opening for the camshaft and which is aligned with a third through-opening arranged in the connecting element, and which is formed for the insertion of a screw which fixates the bearing device and thus the camshaft on the cylinder head. The arrangement according to the invention of the different through-openings allows a simultaneous fixation of the connecting element, the associated bearing block, and thus of the camshaft on the cylinder head with few screws compared to the prior art, whereby in particular the variety of parts and thus the assembly efforts can be considerably reduced. A separate mounting of a lower bearing shell and an upper bearing shell in association with the respective additionally necessary fasteners and a subsequent finishing machining of the bearing shells with the camshaft being mounted can thus be eliminated.

In a further advantageous embodiment of the solution according to the invention, on the connecting element of the bearing device, latching elements and/or latching contours are provided by means of which the bearing device together with the camshaft can be detachably and firmly mounted on the cylinder head cover. Such latching elements or latching contours can be configured in the form of clip elements allowing a simple clipping of the cylinder head cover onto the bearing device. Subsequently, the unit consisting of cylinder head cover and bearing device including camshaft can simply be put onto the cylinder head and can be connected to the same, in particular screwed, by means of appropriate fasteners. The clipping between cylinder head cover and bearing device facilitates in particular the positioning of the two components to one another, thereby simplifying the mounting process. In particular in case of a cylinder head cover formed from plastic, the latching elements can be molded in a simple manner by means of the injection molding method, that is, can be manufactured together with the cylinder head cover as one piece. The latching elements or latching contours are arranged on the bearing device or the cylinder head cover, respectively, in such a manner that a fastening of the bearing device on the cylinder head cover is only possible in a predefined position in which the later mounting of the two components on the cylinder head is possible without problems.

Further important features and advantages arise from the sub-claims, from the drawings, and from the associated description of the figures based on the drawings.

It is to be understood that the above mentioned features and the features yet to be explained hereinafter can be used not only in the respectively mentioned combination but also in other combinations or alone without departing from the scope of the present invention.

BRIEF DESCRIPTUION OF THE DRAWING

Preferred exemplary embodiments of the invention are illustrated in the drawings and are explained in the following description in more detail, wherein identical reference numbers refer to identical, or similar, or functionally identical components.

Figure 2A:
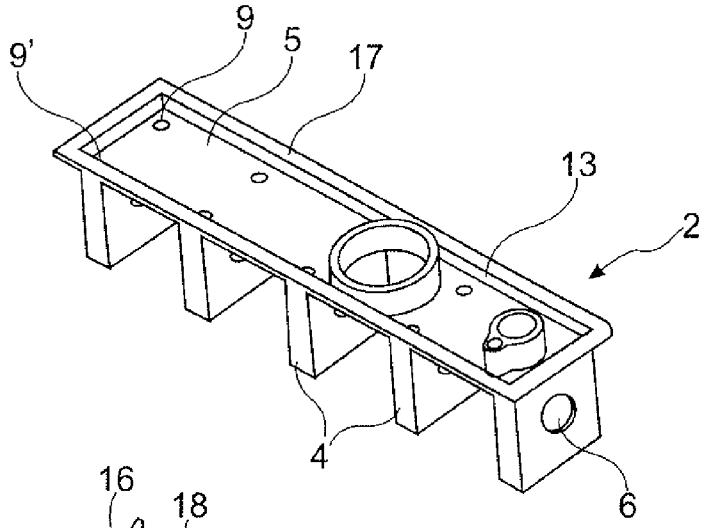
Figure 2B:
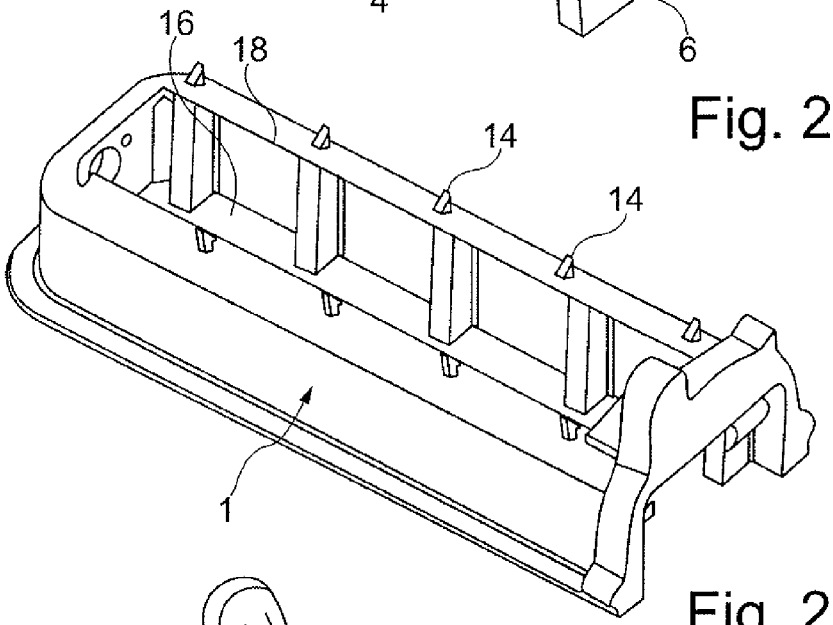
Figure 3:
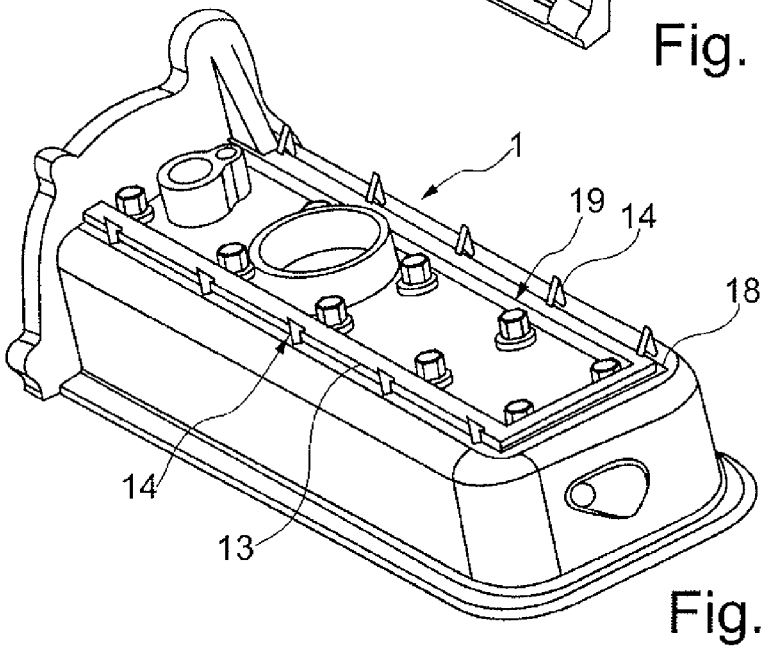
Figure 5:
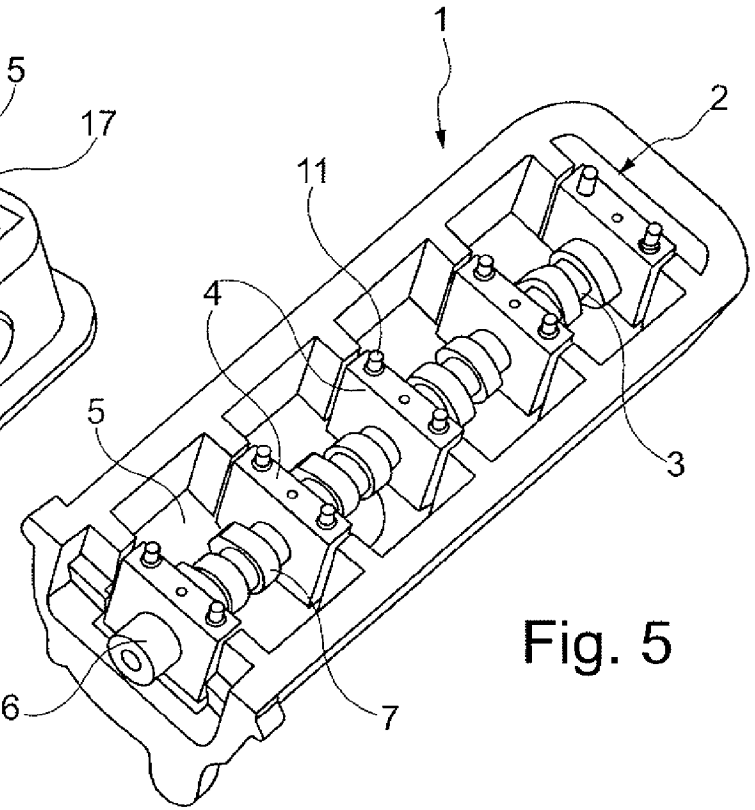
Figure 4:
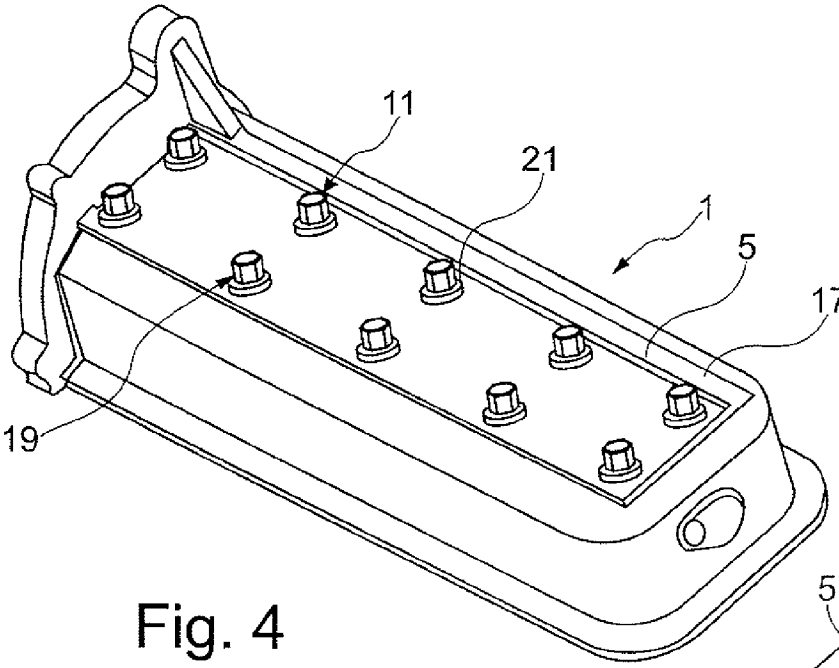
Figure 6:
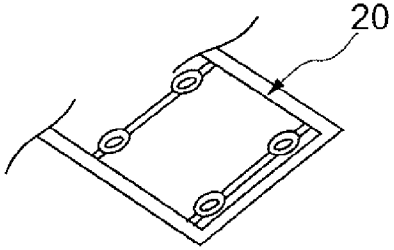

In the figures:

FIG. 1 shows schematically a cylinder head cover according to the invention with a bearing device, FIG. 2*a* shows schematically a view on a bearing device, FIG. 2*b* shows schematically a cylinder head cover which belongs to the bearing device according to FIG. 2*a*, FIG. 3 shows schematically a unit assembled from a bearing device and a cylinder head, FIG. 4 shows schematically a cylinder head cover with a bearing device in a different embodiment, FIG. 5 shows schematically an illustration of the cylinder head cover with assembled bearing device according to FIG. 4, but in a bottom view, FIG. 6 shows schematically a possible configuration of a seal for sealing the bearing device against the cylinder head cover.

DETAILED DESCRIPTION

According to FIG. 1, a cylinder head cover 1 according to the invention includes one bearing device 2 for supporting a camshaft 3. The bearing device 2 comprises at least two, and according to FIG. 1, a total of five bearing blocks 4, and a connecting element 5 which interconnects the individual bearing blocks 4. The individual bearing blocks include a first through-opening 6 through which the camshaft 3 extends, which camshaft can be formed, for example, as an assembled camshaft. On the camshaft 3, cams 7 are arranged in the usual manner one behind the other and are connected to the camshaft 3 in a rotationally fixed manner.

The bearing blocks 4 together with the connecting element 5 and the camshaft 3 form a prefabricated assembly which can be mounted together with the cylinder head cover 1 to a non-shown cylinder head.

The prefabricatable assembly consisting of the bearing device 2 and the camshaft 3 is fabricated according to the invention as follows:

First, individual cams 7 and, in appropriate distances, the bearing blocks 4 are threaded onto the camshaft 3. The cams 7 are fixedly joined with the camshaft 3 in such a manner that they can actuate adequately allocated and non-illustrated valves by means of a rotational movement of the camshaft 3. The individual bearing blocks 4 are fastened on the connecting element 5 in a position in which they are aligned to one another and to the camshaft 3 so that after preparing the prefabricatable assembly consisting of bearing device 2 and camshaft 3, a subsequent aligning or subsequent machining of the individual bearing blocks 4 is no longer required. After this, the bearing device 2 is mounted together with the cylinder head cover 1 to the cylinder head.

The bearing blocks 4 can principally be made of metal or light metal, in particular of steel or aluminum, as well as the connecting element 5, wherein a connection between the connecting element 5 and the individual bearing blocks 4 is usually carried out by means of a welded connection. The cylinder head cover 1 is preferably formed from plastic.

As FIG. 1 further shows, on each of the bearing blocks 4, two second through-openings 8 and 8' are provided which run transverse to the first through-opening 6 for the camshaft 3 and which each are aligned with third through-openings 9 and 9' corresponding thereto and arranged in the connecting element 5, and with corresponding fourth through-openings 10 and 10' arranged in the cylinder head cover 1 so that the bearing device 2 together with the cylinder head cover can be fixedly connected by means of appropriate connecting means 11, for example screws 11, to the non-shown cylinder head. The connecting means 11 penetrate the cylinder head cover 1, the connecting element 5, and each associated bearing block 4 and are screwed into a bore hole formed on the cylinder head.

Moreover, in the connecting element 5, one or more, in particular a fifth through-opening 12 can be provided which is configured, for example, for receiving a component, in particular a non-shown sensor.

The bearing device 2, according to the invention, can be detachably and firmly fixed on the cylinder head cover 1 in that, for example, latching contours 13 are provided on the connecting element 5, which latching contours interact with corresponding counter latching contours 14, in particular latching elements 14, arranged on the cylinder head cover 1 (cf. FIGS. 2*a* and 3). Of course, it is also conceivable that the latching elements 14 are arranged on the connecting element 5 and the corresponding latching contours 13, which are formed complementary thereto, are arranged on the cylinder head cover 1. However, preferably, the latching elements 14 which, for example, are formed as latching hooks according to FIG. 2, are arranged on the cylinder head cover 1 and can be manufactured with the same in one single work step, provided that the cylinder head cover 1 is formed as injection molded part from plastic.

To achieve a bearing as smooth as possible for the camshaft 3 running in the individual bearing blocks 4, it can also be provided that in at least one bearing block 4, a needle bearing or rolling bearing is provided for supporting the camshaft 3. It is also conceivable that the camshaft 3 is supported directly, that is, without bearing rings, in the bearing blocks 4.

According to FIG. 1, the connecting means 11 are configured as screws 11, in particular as collar screws, and have a hexagon on the end side which makes tightening the screw 11 easier. Between a collar 21 of the screw 11 and the cylinder head cover 1, in addition, a decoupling element 15 is provided which, in particular, is intended to effect a vibration decoupling between screw 11 on one side and cylinder head cover 1 on the other. It is also conceivable that the decoupling element 15 is additionally formed as sealing element, thereby preventing lubricants, in particular oil, contained in the cylinder head from escaping.

Viewing FIG. 2*a*, the bearing device 2 with a total of five bearing blocks 4 supporting a non-illustrated camshaft is clearly visible. The bearing device 2 is inserted from above in its completely assembled state, thus, together with the camshaft 3, into the cylinder head cover 1 which, for this purpose, has an appropriate opening 16. Via a preferably circumferential edge 17, the bearing device 2 rests against or on an opening edge 18 of the opening 16, wherein the latching elements 14 shown according to FIG. 2*b* fix the bearing device 2 in a precisely predefined position on the cylinder head cover 1. Here it is of great advantage that the bearing device 2 fixed in such a manner on the cylinder head cover 1 can be placed together with the cylinder head cover 1 in one single mounting step onto a non-shown cylinder head and can be tightened with the screws 11 without the need that the individual bearing blocks 4 have to be aligned afterwards with respect to the camshaft 3.

In FIG. 4, a cylinder head cover 1 is shown on which the bearing device 2 is supported solely via edge 17, which is formed in a stepped manner, on an opening edge 18 of the cylinder head cover 1. Thus, the step in the edge 17 provides an alignment of bearing device 2 on the cylinder head cover 1. An additional fixation via latching element or latching contours 13 is not provided in this embodiment, but is optionally possible. The screws 11 penetrate the connecting element 5 of the bearing device 2 which forms at the same time the upper closure of the cylinder head cover 1. With their ends facing away from the screw head 19, the screws 11 penetrate the individual bearing blocks 4 and project from below out of the bearing blocks 4 and far enough that they can be screwed into corresponding screw holes provided on the cylinder head (cf. FIG. 5). Also in the embodiments illustrated according to FIGS. 4 and 5, a subsequent aligning of the individual bearing blocks 4 with respect to the camshaft 3 is not required because they are already aligned to one another and to the cylinder head cover 1 by means of the connecting element 5.

In FIG. 6, a possible embodiment of a sealing frame-type seal 20 is illustrated by means of which seal, an escape of oil from the cylinder head can be reliably prevented. The screws 11 can be formed, for example, as expansion screws wherein by means of a direct metallic contact between screw 11 on the one side and cylinder head on the other, an appropriate stiffness is obtained during assembly. The fourth through openings 10 and 10' in the cylinder head cover 1 are surrounded by the decoupling element 15 formed as sealing element in such a manner that a preferably complete acoustic decoupling between cylinder head and cylinder head cover 1 is achieved. In case of the screws 11, as they are shown in FIG. 1, thus, the collar 21 of the screws 11 applies pressure on the decoupling element 15 and via the same onto the cylinder head cover 1 which transfers said force accordingly to a seal 20 (cf. FIG. 1) against the cylinder head. A particular advantage of the cylinder head cover 1 according to the invention is that a separate fastening of the cylinder head cover 1 and the bearing blocks 4 on the cylinder head can be eliminated, and both elements together can be fixed in place by means of the same screws 11. Thereby, the variety of parts and the logistic costs are reduced. In particular, a costly finishing or realigning of the individual bearing blocks 4 can be eliminated because the same are already fixed and aligned to one another by means of the connecting element 5.

The invention claimed is:

1. A cylinder head cover comprising:

a bearing device wherein the bearing device has at least two bearing blocks supporting a camshaft, and a connecting element; and the bearing blocks are co-axially penetrated in a first through-opening by the camshaft and are fixed in an aligned position with respect to one another by means of the connecting element for co-axial penetration by the camshaft;

wherein the bearing blocks together with the connecting element and the camshaft form a prefabricated assembly;

the cylinder head cover is detachably connected with the bearing device, whereby a unit consisting of the cylinder head cover and the bearing device are mounted on the cylinder head;

wherein a second through-opening is provided on at least one bearing block, wherein the second through-opening runs transverse to the first through-opening for the camshaft and is aligned with a third through-opening arranged in the connecting element and a fourth through-opening arranged in the cylinder head cover, such that the second, third, and fourth through-openings are co-axially aligned and formed for the passage of a screw, which fixates the cylinder head cover, the bearing device, and the camshaft on the cylinder head.

2. The cylinder head cover according to claim 1, wherein at least one of the bearing blocks is made of at least one of steel and aluminum, and wherein the connecting element is formed from metal and is welded to the bearing blocks, and wherein the cylinder head cover is formed from at least one of metal and plastic.

3. The cylinder head cover according to claim 1, wherein in the connecting element at least one additional through-opening is provided, which is formed for receiving at least one component.

4. The cylinder head cover according to claim 3, wherein the component is a sensor.

5. The cylinder head cover according claim 1, wherein on the connecting element, at least one of a latching element and a latching contour is provided to detachably fixate the bearing device and the camshaft on the cylinder head cover.

6. The cylinder head cover according claim 1, wherein at least one bearing block has a needle bearing or rolling bearing supporting the camshaft.

7. The cylinder head cover according to claim 1, wherein a decoupling element is provided between the cylinder head cover and at least one of the screws fixating at least one of the cylinder head cover, the bearing device and the camshaft, and wherein the screw is a collar screw.

8. The cylinder head cover according to claim 7, wherein the decoupling element is formed as a sealing element.

9. The cylinder head cover according claim 1, wherein the connecting element forms an integral part of the cylinder head cover.

10. An internal combustion engine comprising:

a cylinder head cover;

a bearing device detachably connected to the cylinder head cover, wherein the cylinder head cover and bearing device are mounted on a cylinder head;

at least two bearing blocks respectively having a first through-opening;

a connecting element connecting and co-axially aligning the each one of the first through-openings of the at least two bearing blocks;

a camshaft, wherein the camshaft axially penetrates the first through-openings of the at least two bearing blocks;

wherein a second through-opening is provided on at least one bearing block, wherein the second through-opening runs transverse to the first through-opening for the camshaft and is aligned with a third through-opening arranged in the connecting element and a fourth through-opening arranged in the cylinder head cover, such that the second, third, and fourth through-openings are co-axially aligned and formed for the passage of a screw, which fixates the cylinder head cover, the bearing device, and the camshaft on the cylinder head.

11. The internal combustion engine according to claim 10, wherein the bearing blocks, connecting element and the camshaft form a prefabricated assembly.

12. The cylinder head cover according to claim 10, wherein at least one of the bearing blocks is made of at least one of steel and aluminum, and wherein the connecting element is formed from metal and is welded to the bearing blocks, and wherein the cylinder head cover is formed from at least one of metal and plastic.

13. The cylinder head cover according to claim 10, wherein in the connecting element at least one additional through-opening is provided, which is formed for receiving at least one component.

14. The cylinder head cover according to claim 10, wherein on the connecting element, at least one of a latching element and a latching contour is provided to detachably fixate the bearing device and the camshaft on the cylinder head cover.

15. The cylinder head cover according to claim 10, wherein at least one bearing block has a needle bearing or rolling bearing supporting the camshaft.

16. The cylinder head cover according to claim 10, wherein a decoupling element is provided between the cylinder head cover and at least one of the screws fixating at least one of the cylinder head cover, the bearing device and the camshaft, and wherein the screw is a collar screw.

17. The cylinder head cover according to claim 16, wherein the decoupling element is formed as a sealing element.

18. The cylinder head cover according to claim 10, wherein the connecting element forms an integral part of the cylinder head cover.

* * * * *